US009236157B2

(12) United States Patent
Kuznetsov et al.

(10) Patent No.: US 9,236,157 B2
(45) Date of Patent: Jan. 12, 2016

(54) TRANSPARENT ELECTRICALLY CONDUCTING OXIDES

(75) Inventors: Vladimir L. Kuznetsov, Oxford (GB); Peter P. Edwards, Oxford (GB)

(73) Assignee: ISIS INNOVATION LIMITED, Oxford (GB)

( * ) Notice: Subject to any disclaimer, the term of this patent is extended or adjusted under 35 U.S.C. 154(b) by 595 days.

(21) Appl. No.: 13/393,822

(22) PCT Filed: Sep. 2, 2010

(86) PCT No.: PCT/GB2010/001664

§ 371 (c)(1),
(2), (4) Date: May 21, 2012

(87) PCT Pub. No.: WO2011/027115

PCT Pub. Date: Mar. 10, 2011

(65) Prior Publication Data

US 2012/0225250 A1 Sep. 6, 2012

(30) Foreign Application Priority Data

Sep. 3, 2009 (GB) ..... 0915376.8

(51) Int. Cl.
*B05D 5/12* (2006.01)
*H01B 1/08* (2006.01)
(Continued)

(52) U.S. Cl.
CPC *H01B 1/08* (2013.01); *C23C 18/08* (2013.01); *C23C 18/1208* (2013.01);
(Continued)

(58) Field of Classification Search
USPC ..... 427/126.3, 446, 452, 453
See application file for complete search history.

(56) References Cited

U.S. PATENT DOCUMENTS 4,391,743 A 7/1983 Maeda et al.
4,705,701 A 11/1987 Akhtar
(Continued)

FOREIGN PATENT DOCUMENTS

EP 0 393 034 B1 10/1990
EP 0 490 493 A2 6/1992
(Continued)

OTHER PUBLICATIONS

Nunes et al. "Effect of different dopant elements on the properties of ZnO thin films", Vacuum 64 (2002) pp. 281-285.*
(Continued)

*Primary Examiner* — Brian K Talbot
(74) *Attorney, Agent, or Firm* — Morrison & Foerster LLP

(57) ABSTRACT

The invention provides a process for producing a transparent conducting film, which film comprises a doped zinc oxide wherein the dopant comprises Si, which process comprises: disposing a composition which is a liquid composition or a gel composition onto a substrate, wherein the composition comprises Zn and Si; and heating said substrate. The invention further provides transparent conducting films obtainable by the process of the invention, including transparent conducting films which comprise a doped zinc oxide wherein the dopant comprises Si, and wherein the film covers a surface area equal to or greater than 0.01 $m^2$. The invention also provides a coated substrate, which substrate comprises a surface, which surface is coated with a transparent conducting film, wherein the film comprises a doped zinc oxide wherein the dopant comprises Si, and wherein the area of said surface which is coated with said film is equal to or greater than 0.01 $m^2$. The invention further provides coatings comprising the films of the invention, processes for producing such films and coatings, and various uses of the films and coatings.

42 Claims, 3 Drawing Sheets

(51) Int. Cl.

| | |
|---|---|
| ***C23C 18/08*** | (2006.01) |
| ***C23C 18/12*** | (2006.01) |
| *B05D 3/10* | (2006.01) |

(52) U.S. Cl.

CPC ..... *C23C 18/1216* (2013.01); *C23C 18/1233* (2013.01); *C23C 18/1245* (2013.01); *C23C 18/1254* (2013.01); *C23C 18/1258* (2013.01); *C23C 18/1291* (2013.01); *C23C 18/1295* (2013.01); *B05D 3/10* (2013.01); *B05D 5/12* (2013.01); *Y10T 428/24479* (2015.01); *Y10T 428/24628* (2015.01); *Y10T 428/24802* (2015.01)

(56) References Cited

U.S. PATENT DOCUMENTS

| | | | | |
|---|---|---|---|---|
| 5,413,864 | A | 5/1995 | Miyazaki et al. | |
| 5,532,062 | A | 7/1996 | Miyazaki et al. | |
| 5,667,880 | A | 9/1997 | Okaniwa | |
| 5,736,267 | A | 4/1998 | Mitsui et al. | |
| 6,071,561 | A | 6/2000 | Gordon et al. | |
| 6,146,765 | A * | 11/2000 | Mitsui et al. | 428/428 |
| 6,200,680 | B1 | 3/2001 | Takeda et al. | |
| 6,208,404 | B1 | 3/2001 | Tomoyori et al. | |
| 6,368,892 | B1 | 4/2002 | Arya | |
| 6,613,603 | B1 | 9/2003 | Sano | |
| 6,677,063 | B2 | 1/2004 | Finley | |
| 6,693,352 | B1 | 2/2004 | Huang et al. | |
| 6,706,962 | B2 | 3/2004 | Nelles et al. | |
| 6,805,601 | B2 | 10/2004 | Aoki et al. | |
| 7,049,638 | B2 | 5/2006 | Wu et al. | |
| 7,052,587 | B2 | 5/2006 | Gibson et al. | |
| 7,122,842 | B2 | 10/2006 | Hill | |
| 7,265,037 | B2 | 9/2007 | Yang et al. | |
| 7,294,811 | B2 | 11/2007 | Kawashima et al. | |
| 7,317,566 | B2 | 1/2008 | Tench et al. | |
| 7,402,506 | B2 | 7/2008 | Levy et al. | |
| 7,511,343 | B2 | 3/2009 | Li et al. | |
| 7,726,263 | B2 | 6/2010 | Ben-Ishai | |
| 2003/0030376 | A1 | 2/2003 | Aoki et al. | |
| 2003/0170437 | A1 | 9/2003 | Kawashima et al. | |
| 2004/0113146 | A1 | 6/2004 | Dahmani et al. | |
| 2004/0150778 | A1 | 8/2004 | Izumi et al. | |
| 2004/0227891 | A1 | 11/2004 | Hirota | |
| 2004/0247929 | A1 | 12/2004 | Buhay et al. | |
| 2004/0252738 | A1 | 12/2004 | Hill | |
| 2004/0262154 | A1 | 12/2004 | Gibson et al. | |
| 2005/0000564 | A1 | 1/2005 | Sato et al. | |
| 2005/0016583 | A1 | 1/2005 | Blieske et al. | |
| 2005/0211290 | A1 | 9/2005 | Deng et al. | |
| 2005/0233113 | A1 | 10/2005 | Kotani et al. | |
| 2005/0274964 | A1 | 12/2005 | Huang et al. | |
| 2006/0008580 | A1 | 1/2006 | Nelles et al. | |
| 2006/0137738 | A1 | 6/2006 | Ahn et al. | |
| 2006/0165572 | A1 | 7/2006 | McHugh et al. | |
| 2006/0197438 | A1 | 9/2006 | Conley, Jr. et al. | |
| 2006/0228974 | A1 | 10/2006 | Thelss et al. | |
| 2006/0250078 | A1 | 11/2006 | Lee et al. | |
| 2006/0255719 | A1 | 11/2006 | Oikawa et al. | |
| 2006/0284171 | A1 | 12/2006 | Levy et al. | |
| 2007/0116986 | A1 | 5/2007 | Garg et al. | |
| 2007/0243328 | A1 | 10/2007 | Liu et al. | |
| 2007/0273973 | A1 | 11/2007 | Kursawe et al. | |
| 2007/0280848 | A1 | 12/2007 | Narayan et al. | |
| 2007/0284590 | A1 | 12/2007 | Goto et al. | |
| 2008/0108198 | A1 | 5/2008 | Wager, III et al. | |
| 2008/0193638 | A1* | 8/2008 | McMaster et al. | 427/126.3 |
| 2008/0193717 | A1* | 8/2008 | Jongerden et al. | 428/142 |
| 2009/0001872 | A1 | 1/2009 | Noel | |
| 2009/0081826 | A1 | 3/2009 | Cowdery-Corvan et al. | |
| 2012/0228665 | A1* | 9/2012 | Fukunaga et al. | 257/99 |
| 2013/0309933 | A1* | 11/2013 | Hirakata | 445/11 |

FOREIGN PATENT DOCUMENTS

| | | | |
|---|---|---|---|
| EP | 0 490 493 | A3 | 6/1992 |
| EP | 0 490 493 | B1 | 6/1992 |
| EP | 0 807 846 | A2 | 11/1997 |
| EP | 0 807 846 | A3 | 11/1997 |
| EP | 0 842 046 | B1 | 5/1998 |
| EP | 0 893 833 | A2 | 1/1999 |
| EP | 0 893 833 | A3 | 1/1999 |
| EP | 0 893 833 | B1 | 1/1999 |
| EP | 1 135 838 | B1 | 9/2001 |
| EP | 1 139 161 | A1 | 10/2001 |
| EP | 1 178 709 | A1 | 2/2002 |
| EP | 1 178 709 | A4 | 2/2002 |
| EP | 1 701 396 | A2 | 9/2006 |
| EP | 1 701 396 | A3 | 9/2006 |
| EP | 1 701 396 | B1 | 9/2006 |
| EP | 1 732 139 | A1 | 12/2006 |
| EP | 1 732 362 | A1 | 12/2006 |
| EP | 1 732 362 | A4 | 12/2006 |
| EP | 1 796 108 | A1 | 6/2007 |
| EP | 1 796 108 | A4 | 6/2007 |
| EP | 1 847 632 | A1 | 10/2007 |
| EP | 1 850 401 | A1 | 10/2007 |
| EP | 1 865 558 | A2 | 12/2007 |
| EP | 1 865 558 | A3 | 12/2007 |
| EP | 1 905 874 | A1 | 4/2008 |
| EP | 1 905 874 | A4 | 4/2008 |
| EP | 1 930 471 | A2 | 6/2008 |
| JP | 62-080918 | A | 4/1987 |
| JP | 7-288049 | A | 10/1995 |
| JP | 08-045352 | A | 2/1996 |
| JP | 2000-276943 | A | 10/2000 |
| JP | 2002-075062 | A | 3/2002 |
| JP | 2002-217429 | A | 8/2002 |
| KR | 10-2008-0064269 | A | 7/2008 |
| KR | 20080086335 | A | 9/2008 |
| WO | WO-98/08245 | A2 | 2/1998 |
| WO | WO-98/08245 | A3 | 2/1998 |
| WO | WO-01/73850 | A2 | 10/2001 |
| WO | WO-01/73850 | A3 | 10/2001 |
| WO | WO-01/73850 | C2 | 10/2001 |
| WO | WO-01/73903 | A2 | 10/2001 |
| WO | WO-01/73903 | A3 | 10/2001 |
| WO | WO-01/73903 | C2 | 10/2001 |
| WO | WO-2004/023436 | A2 | 3/2004 |
| WO | WO-2004/023436 | A3 | 3/2004 |
| WO | WO-2004/050961 | A1 | 6/2004 |
| WO | WO-2004/066346 | A2 | 8/2004 |
| WO | WO-2004/066346 | A3 | 8/2004 |
| WO | WO-2005/006391 | A2 | 1/2005 |
| WO | WO-2005/006391 | A3 | 1/2005 |
| WO | WO-2005/040044 | A2 | 5/2005 |
| WO | WO-2005/040044 | A3 | 5/2005 |
| WO | WO-2005/088717 | A2 | 9/2005 |
| WO | WO-2005/088717 | A3 | 9/2005 |
| WO | WO-2005/112144 | A1 | 11/2005 |
| WO | WO-2005/125288 | A2 | 12/2005 |
| WO | WO-2005/125288 | A3 | 12/2005 |
| WO | WO-2006/012764 | A1 | 2/2006 |
| WO | WO-2006/022497 | A1 | 3/2006 |
| WO | WO-2006/138071 | A1 | 12/2006 |
| WO | WO-2007/071663 | A1 | 6/2007 |
| WO | WO-2007/135171 | A2 | 11/2007 |
| WO | WO-2007/135171 | A3 | 11/2007 |
| WO | WO-2007/138348 | A2 | 12/2007 |
| WO | WO-2007/138348 | A3 | 12/2007 |
| WO | WO-2008/027086 | A1 | 3/2008 |
| WO | WO-2008/027086 | A8 | 3/2008 |
| WO | WO-2008/106040 | A2 | 9/2008 |
| WO | WO-2008/106040 | A3 | 9/2008 |
| WO | WO-2008/118422 | A1 | 10/2008 |
| WO | WO-2008/143526 | A1 | 11/2008 |
| WO | WO-2009/014590 | A2 | 1/2009 |
| WO | WO-2009/014590 | A3 | 1/2009 |
| WO | WO-2009/014590 | A9 | 1/2009 |
| WO | WO-2009/015192 | A1 | 1/2009 |
| WO | WO-2009/042144 | A2 | 4/2009 |
| WO | WO-2009/042144 | A3 | 4/2009 |

(56) References Cited

FOREIGN PATENT DOCUMENTS

| | | | |
|---|---|---|---|
| WO | WO-2009/064592 | A1 | 5/2009 |
| WO | WO-2009/106828 | A2 | 9/2009 |
| WO | WO-2009/106828 | A3 | 9/2009 |

OTHER PUBLICATIONS

Awasthi, N. et al. (2004). "Optical Properties of Transition Metal (Mn, Fe and V) Doped Zinc Oxide Ceramics and Thin Films," *Mat. Res. Soc. Symp. Proc.* 825E:G2.7.1-G2.7.6.

Das, A.K. et al. (Jul. 31, 2009). "Effect of Si Doping on Electrical and Optical Properties of ZnO Thin Films Grown by Sequential Pulsed Laser Deposition," *Journal of Physics D: Applied Physics* 42(165405):1-7.

Edwards, P.P. et al. (2004, e-published Aug. 6, 2004). "Basic Materials Physics of Transparent Conducting Oxides," *Dalton Trans* 2995-3002.

Fang, Z.B. et al. (2005, e-pub. Apr. 29, 2005). "Transparent Conductive Tb-Doped ZnO Films Prepared by RF Reactive Magnetron Sputtering," *Materials Letters* 59:2611-2614.

Gordon, R.G. et al. (Dec. 1, 2001). "Transparent Conductors and Barrier Layers for Thin Film Solar Cells," *Harvard University* pp. 1-2. (Abstract Only).

Hu, J. et al. (1991). "Textured Fluorine-Doped ZnO Films by Atmospheric Pressure Chemical Vapor Deposition and Their Use in Amorphous Silicon Solar Cells," *Solar Cells* 30:437-450.

Huang, H. et al. (Nov. 2, 2007). "Influence of Annealing on Structural, Electrical and Optical Properties of Dy-Doped ZnO Thin Films," *Journal of Physics D:Applied Physics* 40:7041-7045.

International Search Report mailed on Jan. 7, 2010, for PCT Patent Application No. PCT/GB2009/000534, filed on Feb. 26, 2009, 8 pages.

International Search Report mailed on Feb. 18, 2011, for PCT Patent Application No. PCT/GB2010/001664, filed on Sep. 2, 2010, 5 pages.

Kang, H.S. et al. (2006, e-published Sep. 12, 2005). "Investigation on the Variation of Green, Yellow, and Orange Emission Properties of ZnO Thin Film," *Superlattices and Microstructures* 39:193-201.

Kerr, L.L. (Date Unknown). "Growth, Characterization and Thermodynamic Modeling of Absorber and Transparent Conducting Oxides for Copper Indium Diselenide Based Thin Film Solar Cells," Document Order No. AAI3135189 *The Sciences and Engineering*, 1 page. (Abstract Only).

Kim, I. et al. (2006, e-published Sep. 20, 2006). "Effect of Fluorine Addition on Transparent and Conducting Al Doped ZnO Films," *Journal of Applied Physics* 100(063701):1-6.

Lee, H.W. et al. (2005). "Preparation of Ti-Doped ZnO Transparent Conductive Thin Films by PLD Method," *Journal of Ceramic Processing Research* 6(1):52-56.

Liang, H. (1998). "Atmospheric Pressure Chemical Vapor Deposition of Textured Zinc Oxide, Doped Titanium Dioxide, and Doped Zinc Oxide Thin Films," *The Science and Engineering* 59(01 B):270. (Abstract Only).

Lim, J.H. et al. (2009, e-published Jul. 9, 2009). "Solution-Processed InGaZnO-Based Thin Film Transistors for Printed Electronics Applications," *Applied Physics Letters* 95(012108):1-3.

Lin, W. et al. (Feb. 2008). "Properties of Doped ZnO Transparent Conductive Thin Films Deposited by RF Magnetron Sputtering Using a Series of High Quality Ceramic Targets," *Rare Metals* 27(1):32-35.

Linden, J.L. et al. (May 3, 2003). "Property Control of Transparent Conducting Oxides," *Society of Vacuum Coaters, Inc.* 576-579. (Abstract Only).

Lv, M. et al. (2005, e-published Apr. 26, 2005). "Transparent Conducting Zirconium-Doped Zinc Oxide Films Prepared by RF Magnetron Sputtering," *Applied Surface Science* 252:2006-2011.

Majumder, S.B. et al. (2003). "Investigations on Solution Derived Aluminum Doped Zinc Oxide Thin Films," *Materials Science and Engineering* B103:16-25.

Martinez, A.I. et al. (2005, e-published Feb. 5, 2005). "Effect of the Fluorine Content on the Structural and Electrical Properties of $SnO_2$ and ZnO-$SnO_2$ Thin Films Prepared by Spray Pyrolysis," *Thin Solid Films* 483:107-113.

Minami, T. et al. (Sep. 1986). "Highly Conductive and Transparent Silicon Doped Zinc Oxide Thin Films Prepared by RF Magnetron Sputtering," *Japanese Journal of Applied Physics* 25(9):L776-L779.

Mooney, J.B. et al. (1982). "Spray Pyrolysis Processing," *Ann. Rev. Mater. Sci.* 12:81-101.

Nunes, P. et al. (2002). "Effect of Different Dopant Elements on the Properties of ZnO Thin Films," *Vacuum* 64:281-285.

Ortíz, A. et al. (1988). "Lack of Chemical Interaction of Hydrogenated Amorphous Silicon with Indium-Doped Zinc Oxide Transparent Conductive Films," *Journal of Non-Crystalline Solids* 103:9-13.

Park, J-S. et al. (2009, e-published Jul. 6, 2009). "Flexible Full Color Organic Light-Emitting Diode Display on Polyimide Plastic Substrate Driven by Amorphous Indium Gallium Zinc Oxide Thin-Film Transistors," *Applied Physics Letters* 95(013503):1-3.

Pawar, B.N. et al. (2008, e-published Feb. 29, 2008). "Fluorine-Doped Zinc Oxide Transparent and Conducting Electrode by Chemical Spray Synthesis," *Applied Surface Science* 254:6294-6297.

Rodríguez-Báez, J. et al. (2006, e-published Dec. 19, 2005). "Influence of the Molar Concentration and Substrate Temperature on Fluorine-Doped Zinc Oxide Thin Films Chemically Sprayed," *Materials Letters* 60:1594-1598.

Sato, H. et al. (Nov./Dec. 1993). "Highly Transparent and Conductive Group IV Impurity-Doped ZnO Thin Films Prepared by Radio Frequency Magnetron Sputtering," *J. Vac. Sci. Technol .A.* 11(6):2975-2979.

Souletie, P. et al. (1988). "Growth and Characterization of Heteroepitiaxial ZnO Thin Films by Organometallic Chemical Vapor Deposition," *Journal of Crystal Growth* 86:248-251.

United Kingdom Search Report mailed on Aug. 22, 2008, for Great Britain Patent Application No. GB0803702.0, 1 page.

U.S. Department of Energy. (Date Unknown). "Basic Research Needs for Solar Energy Utilization," *Report of the Basic Energy Sciences Workshop on Solar Energy Utilization Apr. 18-21, 2005*, 276 pages.

Written Opinion mailed on Jan. 7, 2010 for PCT Patent Application No. PCT/GB2009/000534, filed on Feb. 26, 2009, 7 pages.

Written Opinion mailed on Feb. 18, 2011, for PCT Patent Application No. PCT/GB2010/001664, filed on Sep. 2, 2010, 8 pages.

Yi, S-H. et al. (Date Unknown). "Properties of Aluminum Doped Zinc Oxide Thin Film by Sol-Gel Process," *Process of SPIE* 6831(68311A):1-8.

Xue, S. et al. (Jun. 17, 2010). "Study on the Preparation and Ion Implantation of ZnO-Based Films by Sol-gel Process," *China Papers*, located at <http:www.china-papers.com/?p+52651>, last visited Jul. 2, 2013, 3 pages.

Adurodija, F.O. et al. (May 1999). "Pulsed Laser Deposition of Low-Resistivity Indium Tin Oxide Thin Films at Low Substrate Temperature," *Jpn. J. Appl Phys* 38:2710-2716.

European Office Action dated Jun. 11, 2012 for EP Application No. 09715597.2, 6 pages.

Gordon, R.G. et al. (Aug. 2000). "Criteria for Choosing Transparent Conductors," *MRS Bulletin* pp. 52-57.

Groenen, R. et al. (2005, e-published Aug. 16, 2005). "Property Control of Expanding Thermal Plasma Deposited Textured Zinc Oxide with Focus on Thin Film Solar Cell Applications," *Thin Solid Films* 492:298-306.

Hamma, S. et al. (2001). "Low-Temperature Growth of Thick Intrinsic and Ultrathin Phosphorous or Born-Doped Microcrystalline Silicon Films: Optimum Crystalline Fractions for Solar Cell Applications," *Solar Energy Materials & Solar Cells* 69:217-239.

Hayamizu, S. et al. (Jul. 15, 1996). "Preparation of Crystallized Zinc Oxide Films on Amorphous Glass Substrates by Pulsed Laser Deposition," *J Appl Phys* 80(2):787-791.

Hiramatsu, M. et al. (Mar./Apr. 1998). "Transparent Conducting ZnO Thin Films Prepared by XeCl Excimer Laser Ablation," *J Vac Sci Technol A* 16(2):669-673.

Hirata, G.A. et al. (May/Jun. 1996). "High Transmittance-Low Resistivity ZnO:Ga Films by Laser Ablation," *J Vac Sci Technol A* 14(3):791-794.

(56) References Cited

OTHER PUBLICATIONS

Hu, J. et al. (Jan. 15, 1992). "Textured Aluminum-Doped Zinc Oxide Thin Films from Atmospheric Pressure Chemical-Vapor Deposition," *J. Appl Phys* 71(2):880-890.

Hu, J. et al. (Dec. 1, 1992). "Atmospheric Pressure Chemical Vapor Deposition of Gallium Doped Zinc Oxide Thin Films From Diethyl Zinc, Water, and Triethyl Gallium," *J Appl Phys* 72(11):5381-5392.

Islam, M.N. (1987). "The Effects of Deposition Variables on Spray-Deposited ZnO Thin Film Prepared From $Zn(C_2H_3O_2)_2$," *Journal of Materials Science* 22:1379-1384.

Kim, H. et al. (Jun. 7, 1999). "Indium Tin Oxide Thin Films for Organic Light-Emitting Devices," *Applied Physics Letters* 74(23):3444-3446.

Kim, H. et al. (2002). "Doped ZnO Thin Films as Anode Materials for Organic Light-Emitting Diodes," *Thin Solid Films* 420-421:539-543.

Kim, H. et al. (2002). "Epitaxial Growth of Al-Doped ZnO Thin Films Grown by Pulsed Laser Deposition," *Thin Solid Films* 420-421:107-111.

Komaru, T. et al. (2001). "Improved p-i-n. Solar Cells Structure for Narrow Bandgap a-Si:H Prepared by Ar* Chemical Annealing at High Temperatures," *Solar Energy Materials & Solar Cells* 66:329-335.

Manifacier, J.C. (1982). "Thin Metallic Oxides as Transparent Conductors," *Thin Solid Films* 90:297-308.

Minami, T. et al. (1990). "Preparations of ZnO:A1 Transparent Conducting Films by D.C. Magnetron Sputtering," *Thin Solid Films* 193/194:721-729.

Minami, T. (Jul./Aug. 1999). "Transparent and Conductive Multicomponent Oxide Films Prepared by Magnetron Sputtering," *J Vac Sci Technol A* 17(4):1765-1772.

Minami, T. (Aug. 2000). "New n-Type Transparent Conducting Oxides," *MRS Bulletin* 38-44.

Minami, T. (2005). "Transparent Conducting Oxide Semiconductors for Transparent Electrodes," *Semiconductor Science and Technology* 20:S35-S44.

Minami, T. (2008, e-published Mar. 31, 2007). "Substitution of Transparent Conducting Oxide Thin Films for Indium Tin Oxide Transparent Electrode Applications," *Thin Solid Films* 516:1314-1321.

Mizuhashi, M. (1980). "Electrical Properties of Vacuum-Deposited Indium Oxide and Indium Tin Oxide Films," *Thin Solid Films* 70:91-100.

Nam, J.G. et al. (2001). "Synthesis and Sintering Properties of Nanosized $In_2O_3$-10wt%$SnO_2$ Powders," *Scripta Materialia* 44(8/9):2047-2050.

Qadri, S.B. (Dec. 1, 2000). "Transparent Conducting Films of ZnO-$ZrO_2$: Structure and Properties," *Journal of Applied Physics* 88(11):6564-6566.

Sato, H. (1994). "Transparent Conducting ZnO Thin Films Prepared on Low Temperature Substrates by Chemical Vapour Deposition Using $Zn(C_5H_7O_2)_2$," *Thin Solid Films* 246:65-70.

Schuler, T. (1999). "Optical, Electrical and Structural Properties of Sol Gel ZnO:A1 Coatings," *Thin Solid Flims* 351:125-131.

Tahar, R.B.H. (Jul. 15, 1997). "Optical, Structural, and Electrical Properties of Indium Oxide Thin Films Prepared by the Sol-Gel Method," *J Appl Phys* 82(2):865-870.

Tominaga, K. et al. (May/Jun. 1998). "Properties of ZnO:In Film Prepared by Suttering of Facing ZnO:In and Zn Targets," *J Vac Sci Technol A* 16(3):1213-1217.

Kakinuma, K. et al. (2003). "The Relationship Between the Mean Dopant-Ion Radii and Conductivity of Co-Doped ZnO Systems, $Zn_{1-x-y}M_xM'_yO$ (M, M'=Al, In, Ga, Y)," *Journals of Materials Science* 38:7-11.

* cited by examiner

TRANSPARENT ELECTRICALLY CONDUCTING OXIDES

CROSS REFERENCE TO RELATED APPLICATIONS

This application is a National Phase application under 35 U.S.C. §371 of International Application No. PCT/GB2010/001664, having an International Filing Date of Sep. 2, 2010, which claims priority to British Application No. GB 0915376.8 filed on Sep. 3, 2009, each of which are incorporated herein by reference in their entireties.

FIELD OF THE INVENTION

The invention relates to a process for producing a transparent conducting film, to transparent conducting films obtainable by that process, to coatings comprising such films, and to various uses of the films and coatings.

BACKGROUND TO THE INVENTION

Sn-doped $In_2O_3$ thin films [$In_{2-x}Sn_xO_3$: ITO] exhibit a remarkable combination of optical and electrical transport properties. These include a low electrical resistivity, which is typically in the order of $10^{-4}$ Ωcm. This property is related to the presence of shallow donor or impurity states located close to the host ($In_2O_3$) conduction band, which are produced by chemical doping of $Sn^{+4}$ for $In^{+3}$ or by the presence of oxygen vacancy impurity states in $In_2O_{3-x}$. The films also exhibit high optical transparency (>80%) in the visible range of the spectrum (P. P. Edwards, et al.; Dalton Trans., 2004, 2995-3002).

Transparent conductive coatings or layers which comprise ITO have many applications, including in liquid crystal displays, flat panel displays (FPDs), plasma displays, touch panels, printed electronics applications, electronic ink applications, organic light-emitting diodes, electroluminescent devices, optoelectronic devices, photovoltaic devices, solar cells, photodiodes, and as antistatic coatings or EMI shieldings. ITO is also used for various optical coatings, most notably infrared-reflecting coatings (hot mirrors) for architectural, automotive, and sodium vapor lamp glasses. Other uses include gas sensors, antireflection coatings, electrowetting on dielectrics, and Bragg reflectors for VCSEL lasers. Furthermore, ITO can be used in thin film strain gauges. ITO thin film strain gauges can operate at temperatures up to 1400° C. and can be used in harsh environments.

Due to the cost and scarcity of indium metal, the principle component of ITO, a stable supply of indium may be difficult to sustain for an expanding market for flat panel displays, solar cells, printed electronics and other applications. There is therefore an ongoing need to reduce the amount of indium or produce indium-free phases as alternative transparent conducting oxide materials for transparent conductor applications.

The United States Department of Energy (DoE) has outlined various important criteria to be met by transparent conducting oxide materials (TCOs) to be used in such applications. These key requirements for TCOs are outlined in the US DoE document "Basic Research Needs For Solar Energy Utilization", Report on the Basic Energy Sciences Workshop on Solar Energy Utilization, 2005, page 194. That document indicates that TCOs play an important role in all thin-film solar cells, and that the key properties for high-quality TCOs are high optical transmission (high band gap for window materials), low electrical resistivity and high carrier mobility, low surface roughness (for most devices), good thermal and chemical stability, good crystallinity (for most devices), adhesion and hardness, and low processing cost. Commonly used n-type TCOs include indium tin oxide (ITO) and $SnO_2$ (both available commercially coated on glass) and cadmium stannate ($Cd_2SnO_4$). Developing p-type TCOs is also an important goal, because it would open up more possibilities for thin-film device structures, particularly multijunction devices. Materials being investigated include $CuAlO_2$, $CuInO_2$, $CuSrO_2$, and (N, Ga)-doped ZnO.

International application no. PCT/GB2009/000534 (WO 2009/106828) describes a process for producing transparent conducting films of doped zinc oxides by pulsed laser deposition (PLD). The resulting transparent films were found to have temperature-stable electrical and optical properties comparable to those of ITO, and are attractive for transparent conductor applications as they can be produced from inexpensive, abundant precursors, and are non-toxic. Advantageously, therefore, the films go some way to meeting the important DoE criteria for TCOs.

A. K. Das et al., J. Phys. D: Appl. Phys. 42 (2009) 165405 (7 pp) also relates to the production of zinc oxide-based films by PLD.

Although PLD is a very useful tool for the growth of oxides (and other chemically complex systems) by reactive deposition, and allows key research to be performed in exploratory chemical doping programmes, PLD has limited applicability in industry and has certain drawbacks. For instance, in PLD, a compacted solid state target must first be produced. Typically, this target material is synthesised by heating a solid mixture of zinc oxide and one or more other materials which contain the relevant dopant elements. After synthesis, the target material is compacted to form the target and then placed in the chamber of a PLD apparatus. Subsequently, a pulsed laser beam is focussed on the target material to generate a plasma plume, and the plasma is deposited on a substrate to form the transparent conducting film. The PLD process therefore involves several steps, and requires the separate synthesis and preparation of a precursor target material in advance of film deposition.

Furthermore, the nature of the PLD apparatus and process restricts the size of the substrate on which the film is deposited and, in turn, the coverage area of film that can be deposited on a substrate. Substrate size is limited, for instance, by the size of the chamber of the PLD apparatus, the width of the chamber entrance though which the substrate is introduced, and the size of the substrate holder inside the chamber. Accordingly, only relatively small substrates can be coated by PLD. Furthermore, the area of film deposition is limited by the width of the plasma plume that is produced in the PLD apparatus, and the degree to which the substrate is moveable (translatable) relative to the plume within the chamber. Only relatively small-area films can therefore be produced by PLD. For instance, a typical area of homogeneous deposition of thin film produced by a laboratory PLD system is around 0.5 to 1.0 $cm^2$.

Furthermore, the PLD process can lead to films with a non-uniform composition, due to the fact that the PLD ablation plume consists of two components; a high-intensity, leading part, which is usually stoichiometric in target composition, and a lower intensity non-stoichiometric material.

Additionally, both the PLD apparatus and the PLD process are expensive, requiring a vacuum system and an excimer laser.

Finally, the PLD process is usually limited to the deposition of films onto flat surfaces and materials, which restricts the types of substrates that can be coated using PLD.

There is therefore an ongoing need to provide improved, low-cost and simplified processes, which can achieve wide area coverage and overcome the above-mentioned difficulties, and which can produce transparent conducting films that are viable alternatives to ITO, namely films which have low electrical resistivity and high optical transparency in the visible range of the spectrum, are made from inexpensive, non-toxic materials, and address the abovementioned criteria outlined by the US DoE.

SUMMARY OF THE INVENTION

The present inventors have provided an improved process for producing a transparent conducting film of a silicon-doped zinc oxide. Such films have temperature-stable electrical and optical properties which are comparable to those of ITO. The process, which typically involves the deposition of a liquid or gel precursor onto a heated substrate, is advantageous on account of its low cost, its convenience for large-area deposition, its convenience for deposition over curved and/or non-uniform surface topologies, and its simplicity: the deposition and doping steps can effectively be carried out simultaneously. Furthermore, unlike PLD deposition, the process does not require a vacuum system or an expensive excimer laser. The process is therefore inexpensive, and can be performed in ambient conditions (ambient pressure and, aside from heating the substrate, at ambient temperature). The process is therefore easy to handle, inexpensive, suitable for industrial use, and can be used to produce large-area thin films of the transparent conducting oxide. Accordingly, the inventors have devised a new, low-cost method for the effective doping of ZnO with silicon using liquid precursor solutions, which enables the preparation of large area transparent conducting silicon-doped ZnO thin films. The process offers significant economic advantages relative to capital-intensive vapour-phase deposition methods.

Since the films can be made to cover a wide surface area, and since the cost of making ZnO is very low, the films of the invention are particularly attractive for large scale applications such as solid-state lighting, transparent electronics, flat-panel displays, energy-efficient windows and solar cells (particularly large-area solar cells).

The silicon-doped zinc oxide films produced by the process of the invention are attractive for transparent conductor applications as they are easy to produce from inexpensive, abundant precursors, and are non-toxic. Furthermore, silicon-doped zinc oxide has a higher visible transmittance than many other conductive oxide films and is more resistant to reduction by hydrogen-containing plasma processes that are commonly used for the production of solar cells. Zinc oxide itself is also inexpensive, abundant in nature and non-toxic. It also has certain properties which are considered important for transparent conductors, such as a band gap of 3.4 eV, an intrinsic carrier concentration of about $10^{16}$ $cm^{-3}$ and an electron Hall mobility of 200 $cm^2V^{-1}s^{-1}$. By using the process of the invention, large-area silicon-doped zinc oxide films can be produced.

Accordingly, the present invention provides a process for producing a transparent conducting film, which film comprises a doped zinc oxide wherein the dopant comprises Si, which process comprises:

disposing a composition which is a liquid composition or a gel composition onto a substrate, wherein the composition comprises Zn and Si; and heating said substrate.

In another aspect, the present invention provides a transparent conducting film, which film comprises a doped zinc oxide wherein the dopant comprises Si.

Typically, the film covers a surface area equal to or greater than 0.01 $m^2$.

The film may be flat, i.e. substantially planar. In another embodiment, the film is non-planar. The film may for instance comprise one or more uneven regions. In one embodiment, the film comprises one or more curved regions. In one embodiment, the film is uneven or curved.

In another aspect, the present invention provides a coated substrate, which substrate comprises a surface, which surface is coated with a transparent conducting film, wherein the film comprises a doped zinc oxide wherein the dopant comprises Si.

Typically, the area of said surface which is coated with said film is equal to or greater than 0.01 $m^2$.

The surface which is coated with said film may be flat, i.e. substantially planar. In another embodiment, the surface which is coated with said film is non-planar. The surface which is coated with said film may for instance comprise one or more uneven regions and/or one or more curved regions. In one embodiment, the surface which is coated with said film is uneven or curved.

The invention further provides:

- a transparent conducting film which is obtainable by the process of the invention;
- a transparent conducting coating which comprises a transparent conducting film of the invention;
- an organic light-emitting device, an electroluminescent device, a solid-state light, a photovoltaic device, a solar cell, a photodiode, a transparent electronic device, an electrode, a display, a touch panel, a sensor, a window, flooring material, a mirror, a lense, a Bragg reflector, a strain gauge or a radio-frequency identification (RFID) tag which comprises a transparent conducting coating of the invention or a transparent conducting film of the invention; and
- glass or a polymer which is coated with the transparent conducting coating of the invention.

DETAILED DESCRIPTION OF THE INVENTION

Figure 1:
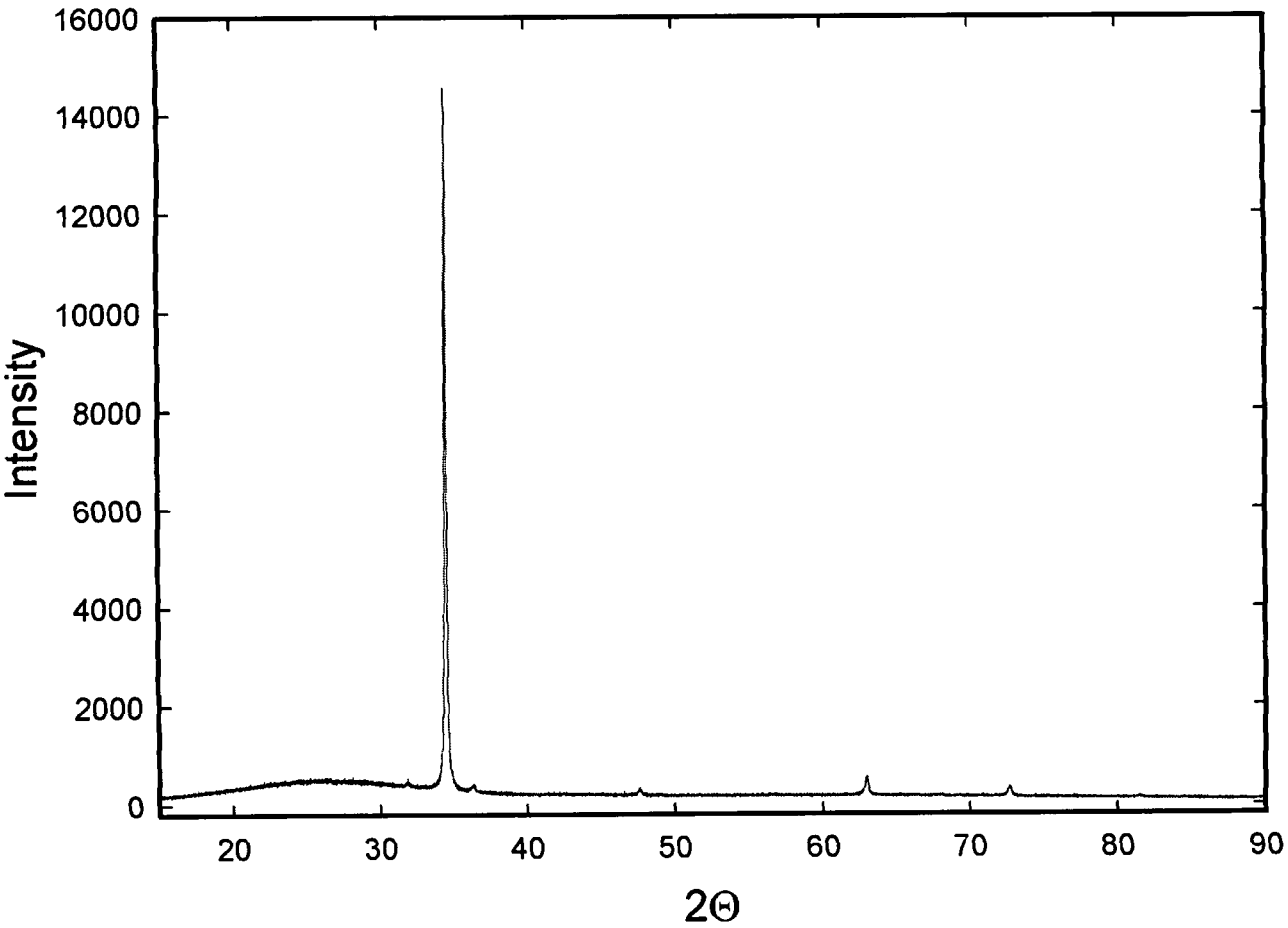
FIG. 1 is an X-ray diffraction pattern of a ZnO thin film doped with 2 mol % of silicon and deposited on a glass substrate by spray pyrolysis at 400° C., in accordance with the invention.

The invention relates to an improved process for producing a transparent conducting film of a silicon-doped zinc oxide.

The films produced by the process of the invention are both transparent and conducting. The word "transparent" as used herein means that the film has optical transmittance in the visible range of the spectrum, from about 400 nm to about 800 nm.

Usually, the film produced by the process of the invention has a mean optical transparency in the visible range of the spectrum which is equal to or greater than about 50%. More typically, the mean optical transparency is equal to or greater than about 70%, or equal to or greater than about 75%. Even more typically, the mean optical transparency in the visible range of the spectrum is equal to or greater than about 80%. In one embodiment, the transparency of the film is optimised to a value equal to or greater than about 90%.

The word "conducting" as used herein means that the film is electrically conductive.

Pure zinc oxide films usually exhibit low conductivity (high resistivity) due to low carrier concentration. In order to decrease the electrical resistivity (increase electrical conductivity) it is necessary to increase either the carrier concentration or the carrier mobility in zinc oxide. The former may be achieved through either oxygen and/or zinc non-stoichiometry or doping with an impurity. Non-stoichiometric films have excellent electrical and optical properties, but they are not very stable at high temperatures. The films produced by the process of the invention are therefore doped with a dopant which comprises Si (silicon). Accordingly, the films of the invention may be doped with Si only or with Si and one or more other dopant elements.

The films produced by the process of the invention have an electrical resistivity which is less than that of a pure, undoped, stoichiometric zinc oxide film, i.e. less than about $2.0\times10^{-2}$ Ωcm.

Usually, the film produced by the process of the invention has an electrical resistivity, ρ, of less than or equal to about $1.0\times10^{-2}$ Ωcm. More typically, the film has an electrical resistivity of less than or equal to about $8.0\times10^{-3}$ Ωcm, less than or equal to about $6.0\times10^{-3}$ Ωcm.

In another embodiment, the film produced by the process of the invention has an electrical resistivity, ρ, of less than or equal to about $5.0\times10^{-3}$ Ωcm, less than or equal to about $4.0\times10^{-3}$ Ωcm or less than or equal to about $3.0\times10^{-3}$ Ωcm. Even more typically, the film has an electrical resistivity of less than or equal to about $2.0\times10^{-3}$ Ωcm.

In one embodiment, the film produced by the process of the invention has an electrical resistivity of less than or equal to about $1.0\times10^{-3}$ Ωcm. More typically, in this embodiment, the electrical resistivity is less than or equal to about $8.0\times10^{-4}$ Ωcm, less than or equal to about $6.0\times10^{-4}$ Ωcm, or less than or equal to about $5.0\times10^{-4}$ Ωcm.

The films produced by the process of the invention are thin films, in order to provide transparency. Typically, the thickness of the film is selected to achieve an optimum balance between conductivity and transparency. Accordingly, the films produced by the process of the invention usually have a thickness, d, of from about 100 Å (10 nm) to about 1 mm. More typically, the thickness, d, is from about 100 nm to about 100 μm. Even more typically, the thickness is from about 100 nm to about 1 μm or, for instance, from about 200 nm to about 1000 nm, or from about 200 nm to about 500 nm. In one embodiment, the thickness is about 4000 Å (400 nm). In another embodiment, the thickness is about 3000 Å (300 nm).

The films produced by the process of the invention are doped with a dopant which comprises Si (silicon). Accordingly, the films of the invention may be doped with Si only or with Si and one or more other dopant elements. This usually increases the carrier concentration, n, in the zinc oxide, without seriously reducing the Hall carrier mobility, μ, thereby decreasing the electrical resistivity of the film. The carrier concentration, n, in the film of the invention is typically greater than that of a pure, undoped, stoichiometric zinc oxide film. Thus, typically, the carrier concentration, n, in the film of the invention is greater than about $1\times10^{19}$ $cm^{-3}$. More typically, the carrier concentration, n, is equal to or greater than about $8\times10^{19}$ $cm^{-3}$ or, for instance, equal to or greater than about $1\times10^{20}$ $cm^{-3}$. Even more typically, n is equal to or greater than about $2\times10^{20}$ $cm^{-3}$. In one embodiment, it is equal to or greater than about $3\times10^{20}$ $cm^{-3}$, for instance equal to or greater than about $5\times10^{20}$ $cm^{-3}$, or equal to or greater than about $6\times10^{20}$ $cm^{-3}$.

In one embodiment, the transparent conducting film has a carrier concentration of at least $1.0\times10^{20}$ $cm^{-3}$.

Typically, the Hall mobility, μ, is equal to or greater than about 5 $cm^2V^{-1}s^{-1}$. More typically, μ is equal to or greater than about 8 $cm^2V^{-1}s^{-1}$. In another embodiment, the Hall mobility, μ, is equal to or greater than about 10 $cm^2V^{-1}s^{-1}$. For instance, μ may be equal to or greater than about 15 $cm^2V^{-1}s^{-1}$.

The process of the invention for producing a transparent conducting film comprises the steps of disposing a composition which is a liquid composition or a gel composition onto a substrate, wherein the composition comprises Zn and Si; and heating said substrate. The composition must comprise both Zn and Si, in the desired ratio, in order that the process results in the formation of a doped zinc oxide with the desired concentration of the dopant element Si. Additional dopant elements can be introduced, by including those elements in the composition too, in the desired concentration (for instance in the form of one or more precursor compounds). Zn and Si are typically present in the form of two separate precursor compounds, namely a zinc-containing compound (typically a zinc salt, such as zinc diacetate or zinc citrate) and a silicon-containing compound (typically a silicon salt, for instance silicon tetraacetate). Typically, the zinc-containing compound further comprises the element oxygen. Typically, the silicon-containing compound further comprises the element oxygen. The zinc-containing compound and the silicon-containing compound are typically a zinc salt and a silicon salt respectively. Any suitable zinc and silicon salts may be used. Typically, however, the salts must be soluble in a solvent (typically in a polar solvent). Thus, suitable salts include organic acid salts, for instance acetate and citrate salts of zinc, the nitrate and halide salts of zinc, and the organic acid salts of silicon, for instance silicon tetraacetate. In another embodiment, however, Zn and Si are present in one and the same precursor compound in the composition. An example of a compound comprising both zinc and silicon is zinc silicate.

The composition is typically a liquid composition, i.e. a composition in the liquid state. Such liquid compositions are typically solutions or dispersions of a Zn- and Si-containing compound or Zn- and Si-containing compounds in a solvent. Suitable Zn- and Si-containing compounds would include zinc salts and silicon salts respectively, for instance organic acid salts, for instance acetate and citrate salts, of zinc, the nitrate and halide salts of zinc, and organic acid salts of silicon, for instance silicon tetraacetate. Any suitable solvent may be employed. Typically, however, the solvent is a polar solvent. For instance, the solvent may comprise water, an alcohol, or a mixture of solvents comprising an alcohol and water. The precursor solution is therefore prepared by dissolving the appropriate amounts of a zinc compound and a silicon compound in an appropriate volume of a solvent or a mixture of solvents. Typically, the zinc compound is a zinc salt and the silicon compound is a silicon salt. Any suitable zinc and silicon salts soluble in polar solvents may be used, for instance acetates, nitrates, chlorides or zinc and silicon salts formed by other anions. Typically, the solvent comprises water and/or an alcohol mixed in the proportion between 0% and 100% of alcohol. Typically, between 0.5% and 10 vol. % of a mineral or organic acid is added to the precursor solution to prevent hydrolysis of zinc and silicon salts.

The liquid composition need not contain a solvent, but could instead be a neat liquid. A suitable neat liquid would be one comprising or more liquid compounds which comprise Zn and Si. For instance, the liquid composition could comprise a mixture of a liquid zinc compound and a liquid silicon compound. Silicon compounds in the liquid state include various organosilanes (tetramethylsilane, for instance), whereas various zinc compounds in the liquid state are known, including organo-zinc compounds such as diethyl zinc.

In one embodiment, the composition is a gel composition, i.e. a composition in the gel form. A gel may be defined as a substantially dilute crosslinked system, which exhibits no flow when in the steady-state. Many gels display thixotropy—they become fluid when agitated, but resolidify when resting. In one embodiment, the gel composition used in the present invention is a hydrogel composition which comprises Zn and Si. In another embodiment, the gel composition is an organogel composition which comprises Zn and Si.

Gel compositions can advantageously be used in a sol-gel approach, wherein the step of disposing the composition onto a substrate comprises depositing a sol gel onto the substrate. The substrate is subsequently heated to form the film. The sol gel route is an inexpensive technique that allows for the fine control of the resulting film's chemical composition. Even very small quantities of the silicon dopant can be introduced throughout the sol and end up uniformly dispersed in the final product film. Accordingly, in one embodiment the composition comprises a sol gel.

In the process of the invention, the liquid or gel composition can be disposed (or deposited) onto the substrate by any suitable method. Suitable methods include spraying, dip-coating and spin-coating.

Dip coating typically refers to the immersing of the substrate into a tank containing the composition, removing the substrate from the tank, and allowing it to drain. Thus, dip-coating typically involves three stages: (i) immersion: the substrate is immersed in the composition at a constant speed, preferably without juddering the substrate; (ii) dwell time: the substrate remains fully immersed in the composition and motionless to allow for the coating material to apply itself to the substrate; and (iii) withdrawal: the substrate is withdrawn, again at a constant speed to avoid any judders. The faster the substrate is withdrawn from the tank the thicker the coating of the Zn- and Si-containing composition that will be applied to the substrate.

In spin coating, an excess amount of the Zn- and Si-containing composition is placed on the substrate, which is then rotated at high speed in order to spread the fluid on the substrate thinly by centrifugal force. A spin coater or spinner is typically employed. Rotation is continued while the fluid spins off the edges of the substrate, until the desired thickness of film is achieved. The applied composition is usually volatile, and simultaneously evaporates. Accordingly, the higher the angular speed of spinning, the thinner the film. The thickness of the film also depends on the concentration of the composition and the solvent. Spin coating can be used to create thin films with thicknesses below 10 nm.

Accordingly, in the process of the invention, the step of disposing the composition onto the substrate comprises spraying, dip-coating or spin-coating the composition onto said substrate.

Preferably, the step of disposing the composition onto the substrate comprises spraying the composition onto the substrate. In other words, the composition is typically disposed on the substrate by spray deposition. In spray deposition, a jet of fine droplets of the composition is sprayed onto the substrate, typically through a nozzle with the aid of a pneumatic carrier gas. Typically, in this embodiment, the composition is a liquid composition as opposed to a gel. More typically, it is a solution or a dispersion. Thus, a solvent is typically present. Any suitable solvent may be employed. Typically, however, the solvent is a polar solvent. For instance, the solvent may comprise water, an alcohol, or a mixture of solvents comprising an alcohol and water. Spray deposition has the advantages that the formation of fine droplets in the spray encourages the some or all of the unwanted solvent to evaporate as deposition onto the substrate occurs; it also allows a fine thin layer of film to be built-up gradually.

When the step of disposing the composition onto the substrate comprises spraying the composition onto the substrate, the composition typically comprises: a compound comprising Zn, a compound comprising Si, and a solvent. The compound comprising Zn may be dispersed in the solvent, but is more typically dissolved in the solvent. Similarly, the compound comprising Si may be dispersed in the solvent, but it is more typically dissolved. Accordingly, the composition typically comprises a solution comprising said compound comprising Zn, said compound comprising Si, and a solvent.

Typically, in the process of the invention for producing a transparent conducting film, the steps of disposing the composition onto the substrate and heating the substrate are performed simultaneously. Simultaneous deposition onto the substrate and heating of the substrate is particularly preferable in embodiments where the composition is disposed onto the substrate by spraying it onto the substrate. Indeed, such embodiments embrace the production of transparent conducting films by spray pyrolysis, wherein spraying said composition onto the heated substrate causes pyrolitic decomposition of the composition and formation of a layer of the doped zinc oxide. Such embodiments of the invention are particularly advantageous because the two steps of (i) preparing a doped compound and (ii) depositing that compound in the form of a thin film are effectively performed simultaneously.

Accordingly, in one embodiment of the process of the invention, the steps of spraying the composition onto the substrate and heating the substrate are performed simultaneously. Typically, in this embodiment, the process of the invention comprises spray pyrolysis.

Spray pyrolysis is a process in which a thin film is deposited by spraying a solution on a heated surface, where the constituents react to form a chemical compound which may be amorphous or crystalline. Both the amorphous and crystalline forms typically have important and characteristic optical and electrical properties. Typically, in the present invention, the constituents react to form the chemical compound of formula (I) as defined herein. The chemical reactants are selected such that the products other than the desired compound are volatile at the temperature of deposition. It has been found that the process is particularly useful for the deposition of doped zinc oxide films, wherein the dopant comprises Si, including films comprising compounds of formula (I). Such transparent conducting films can easily be applied to substrates such as glass using spray pyrolysis, and can be applied to cover large areas of such substrates. Since the films can be made to cover a wide surface area, and since the cost of making ZnO is very low, the films of the invention are particularly attractive for large scale applications such as solid-state lighting, transparent electronics, flat-panel displays and solar cells (particularly large-area solar cells).

A typical spraying apparatus for use in spray pyrolysis is described in Ann. Rev. Mater. Sci. 1982, 12:81-101, the contents of which are incorporated herein by reference. A propellant gas or carrier gas is introduced into a spray head, as is the liquid composition (the spray solution). Typically, the spraying apparatus provides for measurement of the flow of both the carrier gas and the liquid into the spray head. The spray head (also known as an atomiser or spray nozzle) also comprises an exit, which usually includes a nozzle through which the liquid or solution is propelled by the carrier gas to produce a spray of fine droplets. A pyrex glass or stainless steel spray head can be used, as can other atomizers, such as a resonant cavity or a piezoelectric transducer. The substrate heater is typically an electric heater which is controlled within +/−5° C. through a thermocouple located under the substrate and used as a sensor for a temperature controller.

Typically, in the process of the invention said spraying of the composition onto the substrate is performed with the aid of a carrier gas. The carrier gas propels the composition through the nozzle in the spray head to produce a fine spray of droplets, which are carried to the substrate by the carrier gas.

Significant variables in the spray pyrolysis process are the ambient temperature (which is typically room temperature), carrier gas flow rate, nozzle-to-substrate distance, droplet radius, solution concentration (when the liquid composition is a solution), flow rate of the liquid composition and, for continuous processes where large surface areas of substrate are covered by the transparent conducting oxide, substrate motion. Further factors are of course the chemical composition of the carrier gas and/or environment, and, importantly, substrate temperature.

Typically, the carrier gas comprises air, an inert gas or a mixture of gases, for example a mixture of argon and hydrogen. More typically, the carrier gas is compressed nitrogen, which is also used as a reactor gas.

Typically, in the process of the invention wherein spraying of the composition onto the substrate is performed with the aid of a carrier gas, the step of spraying the composition onto the substrate comprises (i) introducing said composition and said carrier gas into a spray head, wherein the composition is introduced at a first flow rate and the carrier gas is introduced at a second flow rate, wherein the first and second flow rates are the same or different, and (ii) spraying the composition onto said substrate from an exit of said spray head. Typically, the exit of the spray head comprises a nozzle.

Typically, the first flow rate, at which the composition is introduced into the spray head, is from 0.1 ml/min to 20 ml/min. More typically, the first flow rate is from 0.1 ml/min to 10 ml/min. The first flow rate may for instance be about 1 ml/min.

Typically, the second flow rate, at which the carrier gas is introduced into the spray head, is 1 l/min to 30 l/min. More typically, the second flow rate is about 161/min.

Usually, the distance between said exit of said spray head (i.e. the nozzle) and the substrate is from 10 cm to 40 cm, more typically from 20 cm to 30 cm.

Typically, in the process of the invention, the step of spraying the composition onto said substrate comprises spraying a jet of fine droplets of said composition onto the substrate. It is thought that in some cases the droplets reach said substrate and reside on the surface of the substrate as the solvent evaporates, leaving behind a solid that may further react in the dry state. In other cases, the solvent may evaporate before the droplet reaches the surface and the dry solid impinges on the substrate, where decomposition then occurs. In both cases, the constituents comprising Zn, Si and any other desired dopants, in the desired proportions, react to form a transparent conducting doped zinc oxide film.

It is thought that the droplets will typically have a diameter in the order of micrometers, for instance from 1 to 100 μm, or from about 1 to 50 μm.

Small droplets, for instance droplets of from 1 μm to 5 μm in diameter or, more typically, droplets having a diameter of about 1 μm, will produce smaller crytallites on the surface of the heated substrate. These small particles would likely sinter at significantly lower temperatures than larger crystallites, which allows for greater application of the process of the invention to complex structures and substrate geometries, and allows for lower-temperature deposition.

The step of spraying the composition onto said substrate may be performed for a particular duration to achieve a desired film thickness. For instance, in one embodiment, the step of spraying the composition onto said substrate is performed until a film thickness of from 100 nm to 1000 nm is achieved.

In one embodiment, the duration of the step of spraying the composition onto said substrate is from 5 minutes to 40 minutes. The inventors found that such a duration typically leads to a film thickness of 100 nm to 1000 nm.

Large surface area films can be produced very easily by processes of the invention, including by processes wherein the composition is disposed on the substrate by spraying the composition onto the substrate, e.g. by spray pyrolysis processes. Indeed, by moving the substrate relative to the spray jet, or indeed by moving the spray jet relative to the substrate, and/or by employing a larger substrate heater, and/or by using a wider-angle nozzle, the transparent conducting oxide film can be sprayed to cover very large substrate areas. Uniform films can also be produced over large areas using spin coating or dip coating. For instance, large sheets of glass can be dip-coated by the compositions defined herein in accordance with the present invention.

For instance, substrate areas of at least 0.01 $m^2$, at least 0.05 $m^2$, at least 0.1 $m^2$, at least 0.5 $m^2$, at least 1 $m^2$, at least 2 $m^2$, at least 5 $m^2$ and at least 10 $m^2$ can all be covered with transparent conducting doped zinc oxide films wherein the dopant comprises Si, in accordance with the present invention. Accordingly, typically, the film covers a surface area equal to or greater than 0.01 $m^2$, equal to or greater than 0.05 $m^2$, equal to or greater than 0.1 $m^2$, equal to or greater than 0.5 $m^2$, equal to or greater than 1 $m^2$, equal to or greater than 2 $m^2$, equal to or greater than 5 $m^2$, or equal to or greater than 10 $m^2$.

A typical area of a homogeneous deposition of thin film by a laboratory-scale PLD system, on the other hand, is only 0.5 $cm^2$ to 1 $cm^2$. Even industrial-scale PLD systems are not thought able to deposit films much larger than this. For instance, an industrial-scale PLD system would not be able to deposit a film as large as 0.1 $m^2$.

Typically, the substrate is moved relative to the spray at a particular rate that results in a desired film thickness. As the skilled person will appreciate, the quicker the substrate is translated relative to the spray, the thinner the film deposition will be.

The step of heating the substrate typically comprises maintaining the substrate at an elevated temperature for the duration of the step of spraying the composition onto said substrate. Typically, the elevated temperature is from 100° C. to 1000° C., more typically from 100° C. to 800° C., and even more typically from 200° C. to 500° C.

Generally, in the process of the invention for producing a transparent conducting film, which film comprises a doped zinc oxide wherein the dopant comprises Si, the step of heating the substrate typically comprises maintaining the substrate at a temperature of from 100° C. to 1000° C., more typically from 100° C. to 800° C., and even more typically from 200° C. to 500° C.

Typically, the step of heating the substrate is performed in the presence of oxygen, for instance in air. This facilitates decomposition and oxidation of the zinc-containing compound in the composition to form zinc oxide. (Alternatively or additionally, however, the zinc-containing compound and/or the silicon-containing compound may further comprise oxygen.) Other gases may also be present however, particularly if the dopant further comprises an additional element which can be introduced into the zinc oxide by exposing the zinc oxide to a gas comprising that element. In one embodiment, therefore the transparent conducting film comprises a doped zinc oxide wherein the dopant comprises Si and an additional element, wherein the step of heating the substrate is performed in the presence of a gas comprising said additional element. In one embodiment, the additional element is a halogen, for instance fluorine or chlorine.

As the skilled person will appreciate, the ratio of the dopant elements in the composition controls the ratio of those dopant elements in the resulting doped zinc oxide in the transparent conducting film.

Thus, in the process of the invention for producing a transparent conducting film, the molar ratio of Si to Zn in said composition is typically x:(1−x), wherein x is greater than 0 and less than or equal to 0.25.

Such a molar ratio of elements in the composition will generally lead to the same ratio of elements in the resulting transparent conducting film. Accordingly, typically, in this case, the molar ratio of Si to Zn in said doped zinc oxide in the transparent conducting film will be x:(1−x), wherein x is greater than 0 and less than or equal to 0.25.

In another embodiment, the molar ratio of Si to Zn in said composition is x:(1−x), wherein x is from 0.005 to 0.04. Typically, in this embodiment, the molar ratio of Si to Zn in said doped zinc oxide in the transparent conducting film is x:(1−x), wherein x is from 0.005 to 0.04.

Typically, the molar ratio of Si to Zn in said composition and/or in said resulting doped zinc oxide is x:(1−x), wherein x is greater than 0 and less than or equal to 0.25. For instance, x may be greater than 0 and less than or equal to 0.1. More typically, x is greater than 0 and less than or equal to about 0.05; x may for instance be from about 0.01 to about 0.05, or from about 0.01 to about 0.04, for instance from about 0.015 to about 0.035, or from about 0.02 to about 0.03. In one embodiment x is from about 0.03 to about 0.05, for instance x is about 0.04. In another embodiment, x is about 0.03, for instance 0.027.

In one embodiment, x is from 0.015 to 0.035. More typically, in this embodiment, x is from 0.015 to 0.030. Even more typically, x is from 0.015 to 0.025. x may for instance be about 0.02.

In one embodiment, the Si concentration is from 1.5 atom % to 3.5 atom %. More typically, the Si concentration is from 1.5 atom % to 3.0 atom %. Even more typically, the Si concentration is from 1.5 to 2.5 atom %. The Si concentration may for instance be about 2 atom %. In one embodiment, the Si concentration is 2.0 atom %.

In one embodiment, the molar ratio of Si to Zn in said composition is x:(1−x), wherein x is from 0.015 to 0.025, more typically about 0.02. Typically, in this embodiment, the molar ratio of Si to Zn in said doped zinc oxide in the transparent conducting film is x:(1−x), wherein x is from 0.015 to 0.025, more typically about 0.02.

The maximum dopant concentration in the films produced by the process of the invention is typically 25 atom % (based on the total number of Zn and dopant atoms). Accordingly, when the molar ratio of dopant elements (including Si and other dopant elements, when present) to Zn in the films produced by the process of the invention is x:(1-x), the maximum value of x is 0.25. More typically, the dopant concentration is less than about 10 atom %, for instance, less than about 5 atom %. Even more typically, the dopant concentration is less than or equal to about 4 atom %. Even more typically, the dopant concentration is from about 1 to about 4 atom %, for instance from about 1.5 to about 3.5 atom %, or from about 2 to about 3 atom %.

In one embodiment, the dopant concentration is from 1.5 atom % to 3.5 atom %. More typically, the dopant concentration is from 1.5 atom % to 3.0 atom %. Even more typically, the dopant concentration is from 1.5 to 2.5 atom %. The dopant concentration may for instance be about 2 atom %. In one embodiment, the dopant concentration is 2.0 atom %.

Accordingly, when the molar ratio of dopant elements (including Si and other elements) to Zn in the films produced by the process of the invention is x:(1−x), x is more typically greater than 0 and less than or equal to 0.1. More typically, x is greater than 0 and less than or equal to about 0.05; x may for instance be from about 0.01 to about 0.05, or from about 0.01 to about 0.04, for instance from about 0.015 to about 0.035, or from about 0.02 to about 0.03. In one embodiment x is from about 0.03 to about 0.05, for instance x is about 0.04. In another embodiment, x is about 0.03, for instance 0.027.

In one embodiment, x is from 0.015 to 0.035. More typically, x is from 0.015 to 0.030. Even more typically, x is from 0.015 to 0.025. x may for instance be about 0.02.

In one embodiment of the process of the invention, the composition is a solution comprising a zinc compound, a silicon compound, and a solvent. Typically, the zinc compound further comprises O (oxygen). Typically, the silicon compound further comprises O (oxygen). The zinc compound may for instance be zinc acetate and the silicon compound may be silicon tetra-acetate. Typically, the solvent in the composition comprises water and/or an alcohol. Typically, the solution further comprises an acid.

Typically, in this embodiment, the concentration of said zinc compound in said solution is from 0.01 M to 0.5 M. Typically, the concentration of said silicon compound in said solution is from 0.0001 M and 0.005 M.

More typically, the concentration of said zinc compound in said solution is from 0.05 M to 0.1 M. The concentration of said silicon compound in said solution is more typically from 0.001 M and 0.002 M.

These concentration ranges, can be used to produce transparent conducting films comprising silicon-doped zinc oxide wherein the molar ratio of Si to Zn in said doped zinc oxide is x:(1−x), wherein x is about 0.02.

In one specific embodiment, the precursor solution comprises zinc acetate dihydrate ($Zn(CH_3COO)_2.2H_2O$) and silicon tetra-acetate ($Si(CH_3COO)_4$), dissolved in a mixture of isopropanol, water and acetic acid. Typically, appropriate volumes of isopropanol, deionised water and concentrated acetic acid are mixed first in the volumetric ratio of 70:27:3 vol. %, respectively. Then, an appropriate amount of silicon tetra-acetate is dissolved completely in the resulting solution at a temperature from 20 to 90° C., more typically, from 40 to 50° C. Then, an appropriate amount of zinc acetate dihydrate is dissolved in the resulting solution. The concentration of zinc acetate in the final precursor solution is typically between 0.01M and 0.5M; more typically the concentration is between 0.05M and 0.1M. The concentration of silicon tetra-acetate in the final precursor solution is typically between 0.0001M and 0.005M; more typically the concentration is between 0.001M and 0.002M, which gives the Si/(Si+Zn) ratio of around 0.02.

The doped zinc oxide in the transparent conducting film produced by the process of the invention usually comprises a compound of formula (I)

$$Zn_{1-x}[M]_xO_{1-y}[X]_y \quad (I)$$

wherein:

x is greater than 0 and less than or equal to 0.25;

y is from 0 to 0.1;

[X], which is present when y is greater than 0 or absent when y is 0, is at least one dopant element which is a halogen; and

[M] is a dopant element which is Si, or a combination of two or more different dopant elements, one of which is Si.

Typically, in the compound of formula (I), x is from 0.005 to 0.04. More typically, x is from 0.015 to 0.025, and even more typically x is about 0.02.

In one embodiment, x in the compound of formula (I) is greater than 0 and less than or equal to 0.25. For instance, x may be greater than 0 and less than or equal to 0.1. More typically, x is greater than 0 and less than or equal to about 0.05; x may for instance be from about 0.01 to about 0.05, or from about 0.01 to about 0.04, for instance from about 0.015 to about 0.035, or from about 0.02 to about 0.03. In one embodiment x is from about 0.03 to about 0.05, for instance x is about 0.04. In another embodiment, x is about 0.03, for instance 0.027.

In the films produced by the processes of the invention, the dopant, [M], may be Si. Alternatively, [M] may be a combination of two or more different dopant elements, one of which is Si, in any relative proportion such that the total amount of dopant atoms, x, is still greater than 0 and less than or equal to 0.25.

In one embodiment, where [M] is a combination of two or more different dopant elements, one of which is Si, another of said two or more elements is Ga.

In another embodiment, where [M] is a combination of two or more different dopant elements, one of which is Si, another of said two or more elements is In.

In another embodiment, where [M] is a combination of two or more different dopant elements, one of which is Si, another of said two or more elements is Al.

In another embodiment, where [M] is a combination of two or more different dopant elements, one of which is Si, another two of said two or more elements are Ga and In.

In one embodiment, however, where [M] is a combination of two or more different dopant elements, one of which is Si, none of said two or more elements is Ga.

In another embodiment, where [M] is a combination of two or more different dopant elements, one of which is Si, none of said two or more elements is In.

In another embodiment, where [M] is a combination of two or more different dopant elements, one of which is Si, none of said two or more elements is Al.

In another embodiment, where [M] is a combination of two or more different dopant elements, one of which is Si, none of said two or more elements is a group 13 element.

In one embodiment, the transparent conducting film produced by the process of the invention does not contain Ga. In one embodiment, the transparent conducting film does not contain In. In one embodiment, the transparent conducting film does not contain Al. In another embodiment, the transparent conducting film does not contain any group 13 element.

In one embodiment, [M] is a combination of two or more different dopant elements, one of which is Si, wherein another of said two or more different elements is selected from an alkali metal, an alkaline earth metal, a transition metal other than zinc, a p-block element, a lanthanide element or an actinide element. Typically, the p-block element is other than Ga. More typically, the p-block element is other than a group 13 element (i.e. it is other than B, Al, Ga, In and Tl). The p-block element may be a group 14 elements other than carbon and Si.

In this embodiment, the alkali metal is typically selected from Li, Na, K, Rb and Cs. Typically, the alkaline earth metal is selected from Be, Mg, Ca, Sr and Ba. Usually, the transition metal other than zinc is selected from Sc, Ti, V, Cr, Mn, Fe, Co, Ni, Cu, Y, Zr, Nb, Mo, Tc, Ru, Rh, Pd, Ag, Cd, La, Hf, Ta, W, Re, Os, Ir, Pt, Au and Hg. More typically, the transition metal other than zinc is selected from Sc, Ti, Y, Zr, La and Hf. Typically, the p-block element is selected from B, Al, Ga, In, Tl, P, As, Sb, Bi, S, Se, Te and Po. In one embodiment, the p-block element is selected from B, Al, In, Tl, P, As, Sb, Bi, S, Se, Te and Po. In another embodiment, the p-block element is selected from P, As, Sb, Bi, S, Se, Te and Po.

In one embodiment, [M] is a combination of (i) Si; and (ii) a transition metal, p-block or lanthanide element which has an oxidation state of +3. The element which has an oxidation state of +3 may, for instance, be Al, Ga, In or Sc. In one embodiment, however, the element which has an oxidation state of +3 is other than Ga. In one embodiment, the element which has an oxidation state of +3 is other than In. In another embodiment, the element which has an oxidation state of +3 is other than a group 13 element.

Typically, the dopant [M] is a single dopant element which is Si.

Alternatively, [M] may be a combination of two or more different dopant elements, one of which is Si and another of which is Ge, Sn or Pb.

Most typically, [M] is a single dopant element which is Si.

In the film of the invention, when y is greater than 0 and therefore when [X] is present, the at least one dopant element which is a halogen, [X], may be a single halogen element. Thus, [X] may, for instance, be F or Cl. Typically [X] is F. Alternatively, [X] may be a combination of two or more different halogens, in any relative proportion such that the total amount of dopant halogen atoms, y, is still from 0 to 0.1. [X] may, for instance, be a combination of F and another halogen, for instance Cl. Typically, however, [X], when present, is a single halogen element which is F.

As mentioned above, halogens can be introduced into the zinc oxide by exposing the zinc oxide to a gas comprising that halogen element, for instance fluorine or chlorine. Alternatively, the halogen element or elements may be introduced into the film by including appropriate halogen compounds, for instance halogen salts, into the liquid or gel composition used in the process of the invention.

Accordingly, in one embodiment of the process of the invention, the transparent conducting film comprises a compound of formula (I) as defined above wherein y is other than 0 and:

(i) the composition comprises said at least one dopant element which is a halogen;

(ii) the step of disposing the composition onto a substrate is performed in the presence of a gas comprising said at least one dopant element which is a halogen; and/or (iii) the step of heating said substrate is performed in the presence of a gas comprising said at least one dopant element which is a halogen.

Typically, in this embodiment, wherein y is other than 0 and [X] is F.

In another embodiment of the process of the invention, the transparent conducting film comprises a compound of formula (II):

$$Zn_{1-x}[M]_xO_{1-y}F_y \quad (II)$$

wherein x and [M] are as defined above and y is greater than 0 and less than or equal to 0.1.

In another embodiment, y is 0 and the compound of the film of the invention is a compound of formula (III):

$$Zn_{1-x}[M]_xO \quad (III)$$

wherein x and [M] are as defined above.

Typically, [M] is a single dopant element which is Si and y is 0.

Accordingly, in one embodiment the film comprises a compound of formula (IV):

$$Zn_{1-x}Si_xO \quad (IV)$$

wherein x is as defined above.

The process of the invention typically involves the deposition of a liquid or gel precursor composition which decomposes to a low-density film during heating. Although this usually results in the production of a polycrystalline film, it is also possible to produce amorphous thin films using this method, thereby increasing the versatility and utility of the process of the invention compared to prior art methods.

Typically, therefore, the crystal structure of the films produced by the process of the invention (which may be studied by X-ray diffraction) is similar to that of an undoped ZnO film. The film of the invention is usually a polycrystalline film. More typically, it is a polycrystalline, c-axis-oriented film.

In another embodiment, though, the doped zinc oxide in the film produced by the process of the invention is an amorphous doped zinc oxide.

In one embodiment, therefore, the film produced by the process of the invention comprises doped zinc oxide, wherein the dopant comprises Si, which doped zinc oxide is amorphous.

In one embodiment, the film produced by the process of the invention is amorphous.

Usually, the root-mean-square (RMS) surface roughness of the film of the invention is less than that of a pure, undoped stoichiometric zinc oxide film. In one embodiment, the film has a root-mean-square surface roughness value which is equal to or less than 3.0 nm. The root-mean-square surface roughness of a film can be measured using atomic force microscopy (AFM).

Typically, the process of the invention further comprises annealing the substrate. This step is typically performed after the steps of disposing the composition on the substrate and heating the substrate. Thus, the transparent conducting film has tpically already been formed and is annealed in a further step together with the substrate.

The substrate (and film) is typically annealed at a temperature of from 150° C. to 1000° C., more typically from 200° C. to 800° C., and even more typically from 200° C. to 500° C. More typically, the substrate is annealed at a temperature of from 350° C. to 400° C. Typically, the substrate is annealed for about 30 to 60 min.

The annealing step is usually performed in the presence of nitrogen gas. Alternatively, the annealing step may be performed in the presence of an inert gas, such as argon. In another embodiment, the annealing step is performed in the presence of an inert gas and hydrogen.

Typically, therefore, the step of annealing the substrate is performed in a nitrogen atmosphere, or in a mixture of an inert gas and hydrogen.

Any suitable substrate may be employed in the process of the invention. Typically, though, the substrate is transparent in the visible range of the spectrum.

Suitable substrates include substrates that comprise glass, silicon, oxidised silicon, a polymer, a plastic, sapphire, silicon carbide, alumina ($Al_2O_3$), zinc oxide (ZnO), yttrium-stabilised zirconium (YSZ), zirconium oxide ($ZrO_2$), fused silica or quartz.

In one embodiment, the substrate is glass, a silicon wafer, an oxidised silicon wafer or a plastic material (for instance, kapton, PET, polyimide, etc.). Usually, glass and $SiO_2$/Si substrates are used.

The transparent conducting films of the present invention can be produced having patterned structures, by employing various patterning techniques. These include, for instance, etching the film, lithography, screen printing or ink jet printing. In this way, the resulting film can have any desired two-dimensional or three-dimensional pattern.

A patterned film structure is useful in many applications, including in the design of printed electrodes or circuit boards, for instance, where the transparent conductive film is only desired in certain specific places.

In order that the transparent conductive film is deposited on only a portion of the substrate, the substrate surface may be masked before the step of disposing the film on the substrate. In this way the film is only formed on the unmasked areas of the substrate, and does not form on the masked areas. Additionally or alternatively, patterning techniques such as ink jet printing, screen printing, or lithography can be applied to control exactly on which parts of the surface the film is formed. For example, by direct-writing or ink jet printing onto the surface of the substrate in certain places only, film formation occurs only at those places. The resulting film will then have a specific two-dimensional pattern.

Accordingly, in one embodiment of the process of the invention, the film is deposited on only a portion of the surface of the substrate to form a patterned film. Typically, this is achieved by using a patterning technique (for instance by direct writing) or by masking one or more portions of the substrate prior to film formation.

Advantageously, ZnO is an etchable material, so etching can also be used to pattern the transparent conducting films of the invention.

Accordingly, in another embodiment of the process of the invention, the process further comprises subjecting the film to an etching process, thereby producing a patterned film. Any suitable etchant can be used, for instance HBr, HCl, HF and HF/$NH_4$. In one embodiment, the etchant is an HBr, HCl, HF or HF/$NH_4$ etch bath.

Such patterning and etching techniques can be performed more than once and/or in combination with one another, leading to the build-up of a complex two- or three-dimensional film pattern.

The invention further provides a transparent conducting film obtainable by a process as defined in any one of the preceding claims.

Transparent films obtainable by the process of the invention include those which having large surface area coverage, which, as explained previously, are not accessible using PLD film deposition. Indeed, by using spray pyrolysis and moving the substrate relative to the spray jet, or by moving the spray jet relative to the substrate, or by using sol gel or dip-coating techniques, the process of the present invention can be used to produce transparent conducting oxide films that cover very large substrate areas at a very low cost. For instance, substrate areas of at least 0.01 $m^2$, at least 0.05 $m^2$, at least 0.1 $m^2$, at least 0.5 $m^2$, at least 1 $m^2$, at least 2 $m^2$, at least 5 $m^2$ and at least 10 $m^2$ can be fully covered with transparent conducting zinc oxide films in accordance with the present invention. Since the films can be made to cover a wide surface area, and since the cost of depositing ZnO films is very low, the films of the invention are particularly attractive for large scale applications such as solid-state lighting, transparent electronics, flat-panel displays, energy efficient windows and solar cells (particularly large-area solar cells).

Accordingly, the invention provide a transparent conducting film, which film comprises a doped zinc oxide wherein the dopant comprises Si, and wherein the film covers a surface area equal to or greater than 0.01 $m^2$.

Typically, the film covers a surface area equal to or greater than 0.05 $m^2$. More typically, the film covers a surface area of at least 0.1 $m^2$, at least 0.5 $m^2$, at least 1 $m^2$, at least 2 $m^2$, at least 5 $m^2$ or at least 10 $m^2$.

The transparent conducting film of the invention may be as further defined hereinbefore for the transparent conducting films obtainable by the processes of the invention.

Further provided is a coated substrate, which substrate comprises a surface, which surface is coated with a transparent conducting film, wherein the film comprises a doped zinc oxide wherein the dopant comprises Si, and wherein the area of said surface which is coated with said film is equal to or greater than 0.01 $m^2$.

Typically, the area of said surface which is coated with said film is equal to or greater than 0.05 $m^2$. More typically, the area of said surface which is coated with said film is at least 0.1 $m^2$, at least 0.5 $m^2$, at least 1 $m^2$, at least 2 $m^2$, at least 5 $m^2$ or at least 10 $m^2$.

Usually, the transparent conducting film or coated substrate according to the invention comprise a molar ratio of Si to Zn in said doped zinc oxide of x:(1−x), wherein x is greater than 0 and less than or equal to 0.25.

Typically, the doped zinc oxide in the transparent conducting film or coated substrate according to the invention comprises a compound of formula (I)

$$Zn_{1-x}[M]_xO_{1-y}[X]_y \quad (I)$$

wherein:

x is greater than 0 and less than or equal to 0.25;

y is from 0 to 0.1;

[X], which is absent when y is 0 and present when y is other than 0, is at least one dopant element which is a halogen; and

[M] is a dopant element which is Si, or a combination of two or more different dopant elements, one of which is Si.

x and y, [X] and [M] may be as further defined hereinbefore in relation to the transparent conducting films obtainable by the processes of the invention.

Typically, [M] is Si.

In one embodiment, [X] is F and y is greater than 0 and less than or equal to 0.1.

In another embodiment, y is 0 (and [X] is therefore absent).

Typically, the transparent conducting film has a resistivity, ρ, of less than or equal to $6.0\times10^{-3}$ Ωcm.

Usually, the transparent conducting film has a carrier concentration of at least $1.0\times10^{20}$ $cm^{-3}$.

Furthermore, generally, the transparent conducting film has a mean optical transparency in the visible range of the spectrum of greater than or equal to about 75%.

In one embodiment, the film of the invention has a patterned structure. The patterned structure may be a two-dimensionally patterned structure or a three-dimensionally patterned structure.

The transparent conducting films obtainable by the process of the present invention of the invention have electrical and optical properties which are comparable to those of ITO. Furthermore, the films are non-toxic and produced from precursors which are cheaper and more abundant than indium metal. The films therefore represent an attractive alternative to ITO, and can in principle be used instead of ITO in any of the transparent conductor applications of ITO.

Since the cost of making ZnO films is very low, and since the process of the invention can be used to produce transparent films having a large surface area coverage, ZnO is particularly attractive for large scale applications such as solid-state lighting, transparent electronics, flat-panel displays, energy efficient windows and solar cells (particularly large-area solar cells).

By virtue of its electrical and optical properties, the Si-doped zinc oxide film of the invention is particularly suitable for use as a transparent conducting coating in many of the applications for which ITO is useful. For instance, the film of the invention may be used as an antistatic coating, an optical coating, a heat-reflecting coating, an antireflection coating, an electromagnetic interference shield, a radio-frequency interference shield, an electrowetting coating, or a coating for a display, touch panel or sensor. A heat-reflecting coating comprising a doped zinc oxide film of the invention is particularly useful as a coating for a window, for instance an architectural or automotive window. Such heat-reflecting coatings may also be used in vapour lamp glasses.

Accordingly, the invention further provides a transparent conducting coating which comprises a transparent conducting film of the invention.

The invention also provides glass which is coated with a transparent conducting coating of the invention.

The transparent conducting coatings and films of the invention can also be used in electronic devices, for instance in organic light-emitting devices, electroluminescent devices, photovoltaic devices, solar cells and photodiodes. They can also be used in electrodes and in displays, for instance in liquid crystal displays, electroluminescent displays, electrochromic displays, flat panel displays, plasma displays, electronic paper and field emission displays. Additionally, the coatings and films may be usefully employed in touch panels, sensors, flooring material (for instance to provide antistatic flooring), mirrors, lenses, Bragg reflectors, strain guages or a radio-frequency identification (RFID) tags.

Accordingly, the invention further provides an electronic device; an electrode, a display, a touch panel, a sensor, a window, a floor material, a mirror, a lense, a Bragg reflector, a strain guage or a radio-frequency identification (RFID) tag which comprises a transparent conducting coating of the invention or a transparent conducting film of the invention.

The invention additionally provides a substrate which is coated with a transparent conducting coating of the invention. Typically, the substrate is a polymer or glass. Typically, the polymer is flexible. The polymer may be any suitable polymer and is typically a conjugated polymer, for instance PET (polyethylene terephthalate). Such coated polymers are useful in flexible electronics applications.

The present invention is further illustrated in the Examples which follow:

EXAMPLES

Example 1

Preparation of Precursor Solution

A precursor solution was prepared by mixing 17.5 ml of isopropanol, 6.75 ml of deionised water and 0.75 of concentrated acetic acid in a volumetric ratio of 70:27:3, respectively. Then, 0.0133 g of silicon tetra-acetate was completely dissolved in the solvent mixture at a temperature of 50° C. Subsequently, 0.4585 g of zinc acetate dihydrate was dissolved in the resulting solution. The concentration of zinc acetate in the final precursor solution was 0.1 M, and the concentration of silicon tetra-acetate in the final precursor solution was 0.002 M, thereby giving a Si/(Si+Zn) ratio of about 0.02 (i.e. 2 mol % Si). These masses and volumes enable preparation of 25 ml of precursor solution, which is typically used for depositing thin films of around 3-4 $cm^2$. Larger area films may be prepared using larger volumes of precursor solution, as described below in Example 2.

Deposition of a Silicon-doped Zinc Oxide Thin Film by Spray Pyrolysis

The precursor solution was used to prepare a silicon-doped zinc oxide thin film by spray pyrolysis. Nitrogen was used as the carrier gas. The gas was introduced into the nozzle of the spray pyrolysis system at a flow rate of 161/min. At the same time, the precursor solution was introduced into the nozzle at a flow rate of 1 ml/min. Droplets of precursor solution were thereby produced at the nozzle, and carried to the substrate and deposited thereon. A glass substrate was used, which was heated to 400° C. during the deposition process. The duration of the deposition process was approximately 25 minutes.

Following the deposition process, the film was annealed at 400° C. for 45 minutes.

FIG. 1 illustrates the X-ray diffraction profile of the resulting ZnO thin film, doped with 2 mol. % of silicon and deposited by spray pyrolysis technique at 400° C. on a glass substrate. The X-ray diffraction measurements indicate that the film is polycrystalline with a hexagonal structure. The highest diffraction peak at 2θ=34.54 deg. corresponds to the [0 0 2] direction. Other diffraction peaks (0 0 1), (1 0 1), (1 0 2), (1 0 3) and (0 0 4) are also observed, but their intensity is very small compared to that of the (0 0 2) peak, indicating a strongly preferential orientation of the crystallites with the c-axis perpendicular to the substrate surface.

Figure 2:
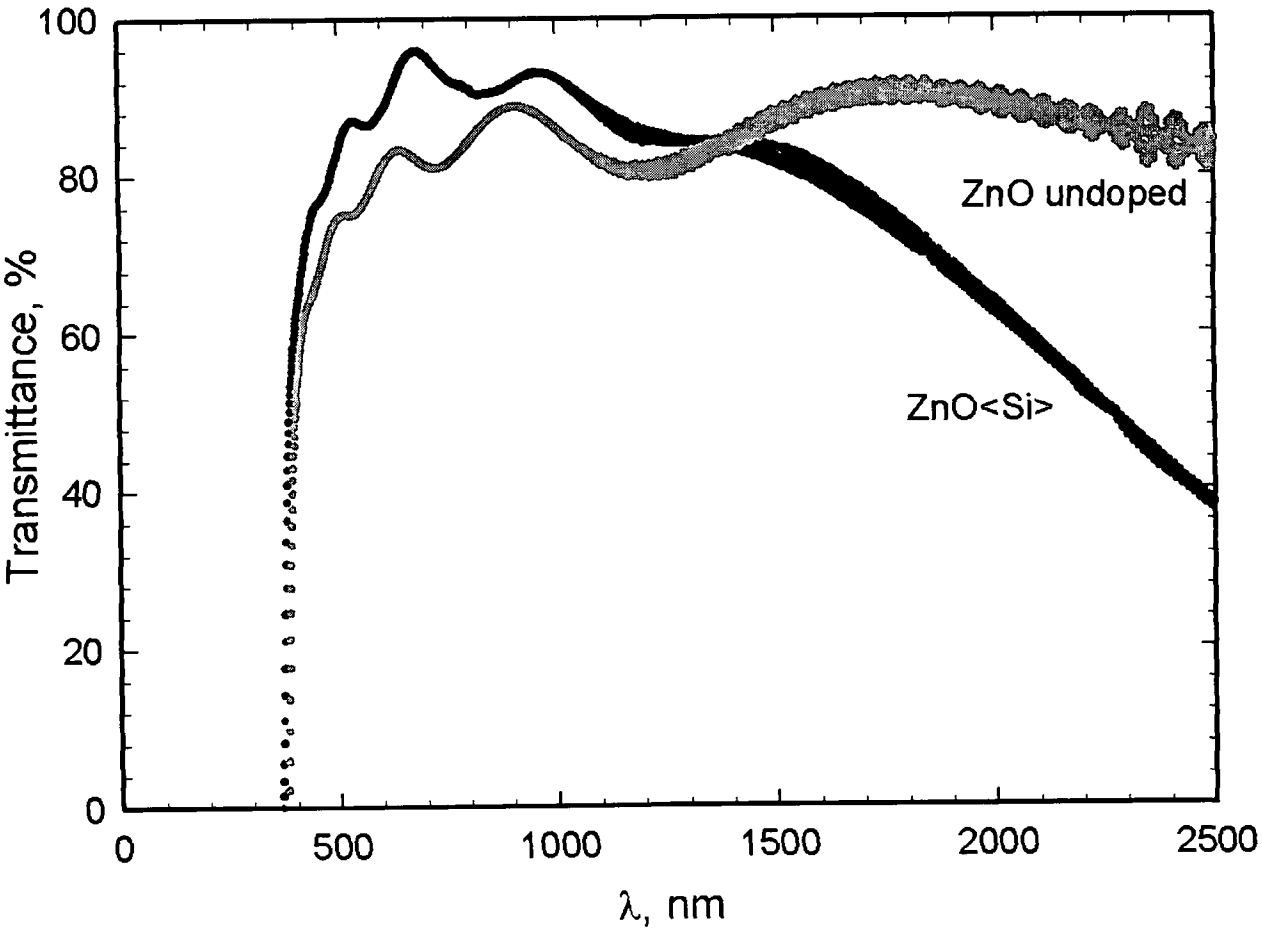
FIG. 2 is a graph of % transmittance (y-axis) versus wavelength in units of nm (x-axis), showing the optical transmittance spectra of (i) an undoped ZnO thin film, and (ii) a ZnO thin film doped with 2 mol. % of silicon in accordance with the invention, deposited at 400° C. on a glass substrate by spray pyrolysis.

FIG. 2 presents the optical transmittance spectra of (a) an undoped ZnO thin film, and (b) the ZnO thin film doped with 2 mol. % silicon, both deposited by the spray pyrolysis technique at 400° C. on glass substrates. It can be seen that the Si-doped ZnO film is highly transparent in the visible region. In the infrared region, its optical transmission decreases compared to the undoped ZnO film; this is due to a significantly higher carrier concentration in the doped film.

Figure 3:
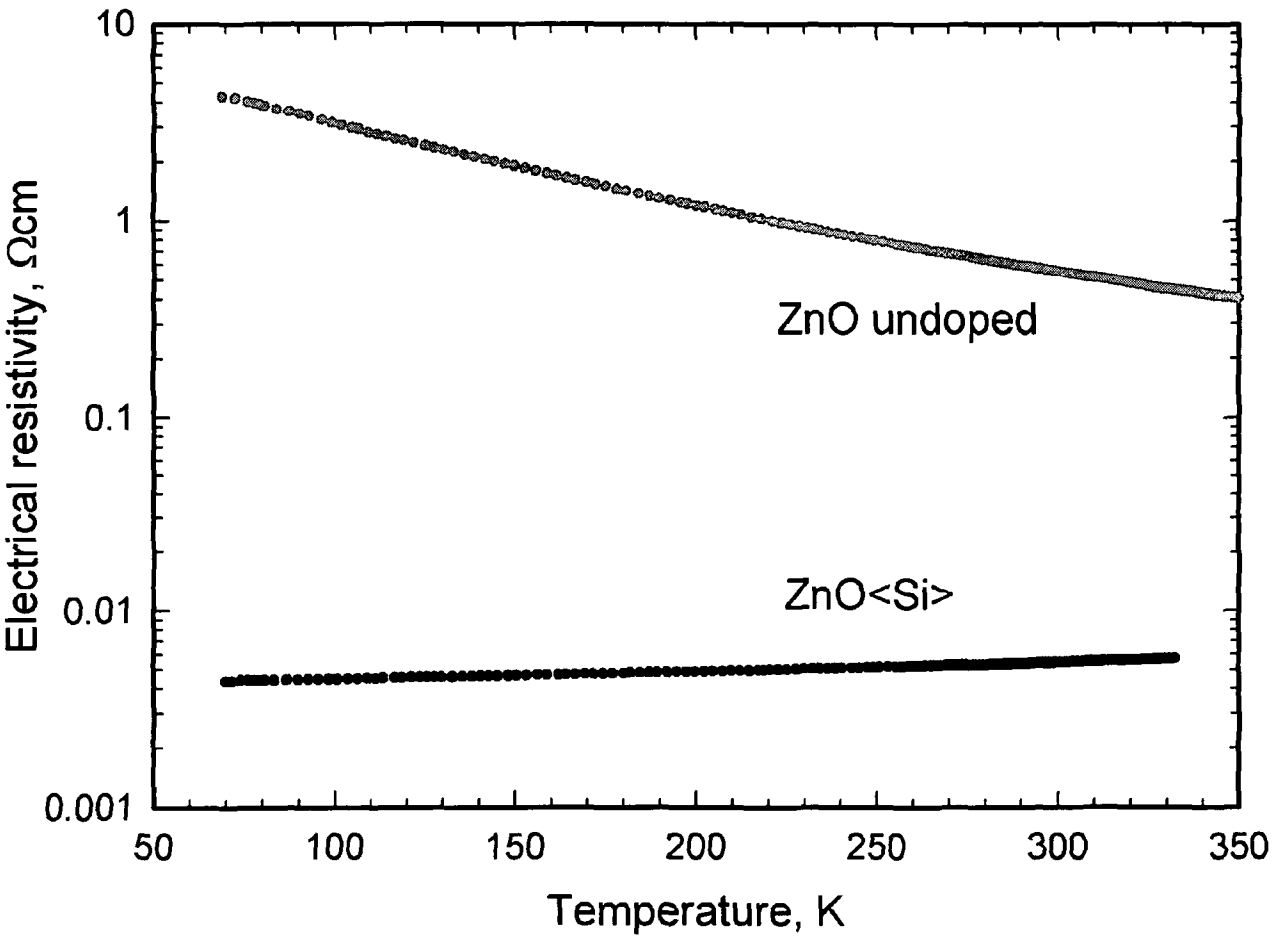
FIG. 3 is a graph of electrical resistivity in units of Ωcm (y-axis), versus temperature in units of Kelvin (x-axis) for (i) an undoped ZnO thin film, and (ii) a ZnO thin film doped with 2 mol. % of silicon in accordance with the invention, deposited at 400° C. on a glass substrate by spray pyrolysis.

The typical temperature dependence of electrical resistivity of the undoped and Si-doped ZnO thin films is presented in FIG. 3. Room temperature electrical transport properties of undoped and Si-doped ZnO thin films prepared by spray pyrolysis method are presented in Table 1. As seen in FIG. 3, the temperature dependence of electrical resistivity of the Si-doped ZnO thin film is typical of metals or heavily doped semiconductors. The room temperature electrical resistivity of doped ZnO thin film is two orders of magnitude smaller than corresponding value of undoped ZnO thin films deposited at the same conditions. These results, together with the direct measurements of carrier concentration presented in Table 1, indicate that liquid precursors can be used for an efficient doping of ZnO thin films with silicon, which enables the preparation of large area transparent conducting Si-doped ZnO thin films by low-cost solution-based deposition methods.

TABLE 1

Electrical transport properties of the undoped ZnO thin film and ZnO thin film doped with 2 mol. % of silicon deposited at 400° C. on glass substrates by spray pyrolysis.

| Sample | Seebeck coefficient (μV/K) | Carrier mobility ($cm^2$/Vs) | Electrical resistivity (Ωcm) | Carrier concentration (1/$cm^3$) |
|---|---|---|---|---|
| Undoped ZnO | −130 | 2.9 | 0.55 | $3.9 \times 10^{18}$ |
| ZnO doped with 2 mol % Si | −50 | 8.2 | 0.0056 | $1.4 \times 10^{20}$ |

Example 2

Preparation of a Larger Volume of Precursor Solution, for Deposition of a Film Over a Surface Area of 0.01 $m^2$ A precursor solution is prepared by mixing 437.5 ml of isopropanol, 168.75 ml of deionised water and 18.75 ml of concentrated acetic acid in a volumetric ratio of 70:27:3, respectively. Then, 0.3325 g of silicon tetra-acetate is completely dissolved in the solvent mixture at a temperature of 50° C. Subsequently, 11.4625 g of zinc acetate dihydrate is dissolved in the resulting solution. The concentration of zinc acetate in the final precursor solution is 0.1 M, and the concentration of silicon tetra-acetate in the final precursor solution is 0.002 M, thereby giving a Si/(Si+Zn) ratio of about 0.02 (i.e. 2 mol % Si).

The precursor solution may then be deposited, using spray pyrolysis as disclosed in Example 1, to form a Si-doped ZnO thin film as described in Example 1, over an area of 0.01 $m^2$.

Even larger area thin films may be prepared by scaling-up the volume of precursor solution accordingly.

The invention claimed is:

1. A process for producing a transparent conducting film, which film comprises a doped zinc oxide wherein the dopant comprises Si, and which film has an electrical resistivity of less than $2.0\times10^{-2}$ Ωcm, which process comprises:

disposing a composition which is a liquid composition or a gel composition onto a substrate, wherein the composition comprises Zn and Si; and simultaneously heating said substrate, wherein spraying the composition onto the heated substrate causes pyrolytic decomposition of said composition and formation of a layer of said doped zinc oxide.

2. A process according to claim 1 wherein the composition comprises a sol gel.

3. A process according to claim 1 wherein the composition is a solution or a dispersion.

4. A process according to claim 3 wherein the composition comprises: a compound comprising Zn, a compound comprising Si, and a solvent.

5. A process according to claim 1 wherein said spraying is performed with the aid of a carrier gas.

6. A process according to claim 5 wherein the step of spraying the composition onto the substrate comprises (i) introducing said composition and said carrier gas into a spray head, wherein the composition is introduced at a first flow rate and the carrier gas is introduced at a second flow rate, wherein the first and second flow rates are the same or different, and (ii) spraying the composition onto said substrate from an exit of said spray head.

7. A process according to claim 6 wherein the exit of the spray head comprises a nozzle.

8. A process according to claim 6 wherein the distance between said exit of said spray head and the substrate is from 10 cm to 40 cm.

9. A process according to claim 1 wherein the step of spraying the composition onto said substrate comprises spraying a jet of fine droplets of said composition onto the substrate.

10. A process according to claim 9 wherein said droplets have a diameter of from 1 to 100μm.

11. A process according to claim 1 wherein the step of spraying the composition onto said substrate is performed until a film thickness of from 100 nm to 1000 nm is achieved.

12. A process according to claim 1 wherein the duration of the step of spraying the composition onto said substrate is from 5 minutes to 40 minutes.

13. A process according to claim 1 wherein the step of heating the substrate comprises maintaining the substrate at an elevated temperature for the duration of the step of spraying the composition onto said substrate.

14. A process according to claim 1 wherein the step of heating the substrate comprises maintaining the substrate at a temperature of from 200° C. to 500° C.

15. A process according to claim 1 wherein the step of heating the substrate is performed in air.

16. A process according to claim 1 wherein the molar ratio of Si to Zn in said composition is x:(1−x), wherein x is greater than 0 and less than or equal to 0.25.

17. A process according to claim 1 wherein the molar ratio of Si to Zn in said doped zinc oxide is x:(1−x), wherein x is greater than 0 and less than or equal to 0.25.

18. A process according to claim 1 wherein the doped zinc oxide comprises a compound of formula (I)

$$Zn_{1-x}[M]_xO_{1-y}[X]_y \quad (I)$$

wherein:

x is greater than 0 and less than or equal to 0.25;

y is from 0 to 0.1;

[X], when present, is at least one dopant element which is a halogen; and

[M] is a dopant element which is Si, or a combination of two or more different dopant elements, one of which is Si.

19. A process according to claim 1 wherein the molar ratio of Si to Zn in said composition is x:(1−x), wherein x is from 0.005 to 0.04.

20. A process according to claim 1 wherein the molar ratio of Si to Zn in said doped zinc oxide is x:(1−x), wherein x is from 0.005 to 0.04.

21. A process according to claim 1 wherein the doped zinc oxide comprises a compound of formula (I)

$$Zn_{1-x[M]x}O_{1-y}[X]_y \quad (I)$$

wherein:

x is from 0.005 to 0.04;

y is from 0 to 0.1;

[X], when present, is at least one dopant element which is a halogen; and

[M] is a dopant element which is Si, or a combination of two or more different dopant elements, one of which is Si.

22. A process according to claim 18 wherein y is other than 0 and:

(i) the composition comprises said at least one dopant element which is a halogen;

(ii) the step of disposing the composition onto a substrate is performed in the presence of a gas comprising said at least one dopant element which is a halogen; and/or (iii) the step of heating said substrate is performed in the presence of a gas comprising said at least one dopant element which is a halogen.

23. A process according to claim 18 wherein y is other than 0 and [X] is F.

24. A process according to claim 1 wherein the composition is a solution comprising a zinc compound, a silicon compound, and a solvent.

25. A process according to claim 24 wherein the zinc compound is zinc acetate and the silicon compound is silicon tetra-acetate.

26. A process according to claim 24 wherein the concentration of said zinc compound in said solution is from 0.01M to 0.5M.

27. A process according to claim 24 wherein the concentration of said silicon compound in said solution is from 0.0001 M and 0.005 M.

28. A process according to claim 24 wherein the concentration of said zinc compound in said solution is from 0.05 M to 0.1 M.

29. A process according to claim 24 wherein the concentration of said silicon compound in said solution is from 0.001M and 0.002M.

30. A process according to claim 24 wherein the solvent comprises water and/or an alcohol.

31. A process according to claim 24 wherein the solution further comprises an acid.

32. A process according to claim 1 which further comprises annealing the substrate.

33. A process according to claim 32 wherein the substrate is annealed at a temperature of from 200° C. to 500° C.

34. A process according to claim 32 wherein the step of annealing the substrate is performed in a nitrogen atmosphere, or in a mixture of an inert gas and hydrogen.

35. A process according to claim 1 wherein the substrate is transparent in the visible range of the spectrum.

36. A process according to claim 35 wherein the substrate comprises glass, silicon, oxidised silicon, a polymer, a plastic, sapphire, silicon carbide, alumina ($Al_2O_3$), zinc oxide (ZnO), yttrium-stabilised zirconium (YSZ), zirconium oxide ($ZrO_2$), fused silica or quartz.

37. A process according to claim 1 wherein the composition is disposed on only a portion of the surface of the substrate, in order to form a patterned film.

38. A process according to claim 1 wherein the process further comprises subjecting the film to etching, thereby producing a patterned film.

39. A process according to claim 1 wherein the transparent conducting film has a resistivity, ρ, of less than or equal to $6.0\times10^{-3}$ Ω cm.

40. A process according to claim 1 wherein the transparent conducting film has a carrier concentration of at $1.0\times10^{20}$ $cm^{-3}$.

41. A process according to claim 1 wherein the transparent conducting film has a mean optical transparency in the visible range of the spectrum of greater than or equal to about 75%.

42. A process according to claim 1 wherein the transparent conducting film has a two- or three- dimensionally patterned structure.

* * * * *